US005134413A

United States Patent [19]

Bruder

[11] Patent Number: 5,134,413

[45] Date of Patent: Jul. 28, 1992

[54] SEGMENTED CYLINDRICAL CORNER REFLECTOR

[75] Inventor: Joseph A. Bruder, Dunwoody, Ga.

[73] Assignee: Georgia Tech Research Corporation, Atlanta, Ga.

[21] Appl. No.: 290,029

[22] Filed: Dec. 27, 1988

[51] Int. Cl.[5] ..... H01Q 15/00

[52] U.S. Cl. ..... 342/174; 342/7

[58] Field of Search ..... 342/5, 6, 7, 9, 165, 342/174

[56] References Cited

U.S. PATENT DOCUMENTS 2,520,008 8/1950 King .
2,953,377 9/1960 Brust .
3,010,104 11/1961 Powell .
3,121,227 2/1964 Frankling .
3,138,798 6/1964 Greenwood .
3,153,235 10/1964 Chatelain .
3,295,132 12/1966 Chapman, Jr. .
4,366,462 1/1983 Campbell et al. .
4,785,301 11/1988 Schafer et al. .

*Primary Examiner*—Mark Hellner
*Attorney, Agent, or Firm*—Hurt, Richardson, Garner, Todd & Cadenhead

[57] ABSTRACT

An even-bounce reflector for calibrating the orthogonal polarizations of a radar system. A segment of a cylindrical reflector is fixed to a flat plate reflector with the angle between the segment of a cylinder and a flat plate being substantially 90 degrees.

4 Claims, 3 Drawing Sheets

SEGMENTED CYLINDRICAL CORNER REFLECTOR

BACKGROUND OF THE INVENTION

This invention relates generally to radar systems, and more particularly to a segmented cylindrical corner reflector as a radar target for calibrating the orthogonal polarizations of a millimeter wave radar.

The increasing utilization of millimeter wave bands for radar applications has led to a need for reflectivity measurements at the corresponding wavelengths. As the frequency increases, smaller scatterers and resonance effects become more important making it very difficult to predict the behavior of the reflective properties of scatterers at millimeter wavelengths. The problems encountered in performing measurements at millimeter waves as opposed to microwaves requires that different techniques be used to resolve the problems.

The polarizations used in reflectivity measurements are typically vertical and horizontal, or left and right circular, although any two orthogonal polarizations can be used. The polarization scattering matrix is a two-by-two complex matrix, with each element of the matrix representing the amplitude and phase of reflection from a target for one of four orthogonal polarization states.

Calibration is especially important at millimeter wavelengths as compared to microwave wavelengths because of the greater effects of variations in measurement equipment and in the environment at the shorter wavelengths. Calibration procedures can be classified as amplitude calibration, phase calibration, and polarization calibration. Amplitude calibration typically involves comparison of a target to be measured with a standard target of known radar cross section (RCS) properties. Phase calibration is necessary for coherent systems to provide phase linearity and stability.

Polarization calibration involves the measurement of the polarization isolation of the system and the use of calibration targets to calibrate the components of the polarization matrix. Polarization isolation can be measured for a dual-polarized radar by transmitting one polarization and receiving the return from a non-polarizing target with the orthogonal polarization.

Radar targets are passive reflectors which have a reflected signal distribution similar to the patterns of an antenna. The basic problem in the design of radar targets is that of maximizing the target returns. The types of radar targets include sphere, cylinder, flat plate, diplane (dihedral corner), triangular trihedral, square trihedral, circular trihedral, and top hat.

The sphere is an easy target to manufacture and has an RCS which is independent of frequency. Its primary disadvantage is a very low RCS for a given size sphere. The cylinder has a narrow angle of return in the plane along its axis and a broad region of return in the plane along the radius. The cylinder is used for calibrating RCS ranges since it can be rotated in azimuth to find the specular return, while orienting the broad radial lobe in the vertical direction.

There are three types of trihedrals, i.e., triangular, square, and circular. The trihedral has wide lobes in both planes and exhibits a relatively large RCS. The triangular trihedral has the widest lobe. The flat plate has the largest RCS for its area of any of the targets but has a narrow lobe in both the vertical and horizontal planes. The plate is hard to align, but when calibration is performed near the ground, its narrow vertical lobe rejects multipath signals.

The diplane (dihedral corner) is the reflector normally used for calibrating orthogonal polarizations. It has a broad beam in the plane perpendicular to the seam and a very narrow beam in the plane along the seam. Its primary disadvantage is in properly aiming it towards the radar because of its narrow beam and the fact that it is often rotated from vertical to obtain orthogonally polarized returns. The top hat reflector has the polarization properties of a diplane while possessing a broad lobe in both the vertical and horizontal planes. Its major disadvantage is its small RCS for a given physical size.

Calibration of orthogonal linear polarizations is based on a unique property of the diplane. If a linearly polarized wave is incident at an angle $\sigma$ relative to the seam between the faces, the reflected wave is also linearly polarized, at an equal, but opposite, angle to the seam. If a dihedral is rotated about an axis parallel to the radar line of sight, the reflected polarization will rotate in the opposite direction at twice the rate. A rotation of 45° to an incident linear polarized wave will return an orthogonal wave.

Circular polarization requires the use of two different types of targets for calibration: an odd-bounce target and an even-bounce target. The cylinder, sphere, trihedral, and flat plate are odd-bounce targets which exhibit an odd number of bounces for incident radiation. An odd-bounce reflector always returns the opposite sense circular polarization because of an odd number of 180° phase reversals at each bounce. As an example, when a left hand circularly polarized wave is reflected from a trihedral, it becomes a right hand circularly polarized wave. A trihedral is commonly used to calibrate odd-bounce circular polarized signals.

The diplane and top hat are even-bounce targets. An even-bounce reflector always returns the same sense circular polarization as the incident wave. For example, a left hand circularly polarized wave is reflected as a left hand circular wave. A diplane is commonly used to calibrate even-bounce circular polarized signals.

There is a need in the art for a radar target for calibrating orthogonal polarizations which has a relatively large RCS and simultaneously a wider lobe in the plane parallel to the seam than does a diplane.

SUMMARY OF THE INVENTION

It is thus an object of this invention to provide an even-bounce reflector that has both a relatively broad beamwidth compared to a dihedral reflector while also providing a relatively large radar cross section.

It is another object of this invention to provide a radar target for calibrating orthogonal polarizations that has a relatively large beamwidth in the plane parallel to the seam of the reflector when compared to that of a diplane reflector.

It is a further object of this invention to provide a radar target for calibrating orthogonal polarizations that has a relatively large RCS when compared to that of a top hat reflector.

The invention is a segmented corner reflector comprising a surface of a cylinder fastened to a flat plate with the cylindrical surface at an angle of 90° to the flat plate. The maximum reflectivity of this reflector occurs when the seam between the bottom of the cylindrical surface and the flat plate at the center line is perpendicular to the direction of propagation and the vertical axis of the flat plate is oriented at an angle of 45° with respect to the direction of propagation. The reflector has a broad beamwidth in the elevation plane as the reflector is rotated about the seam due to the properties of corner reflectors.

In the azimuth direction, as the reflector is pivoted perpendicular to the seam, the reflectivity stays relatively constant as long as the perpendicular from the cylindrical surface to the propagation source is still on the curved reflector. Therefore, this reflector has a relatively broad beamwidth of 5–10 degrees compared to that of a dihedral reflector which has a beamwidth of approximately 0.3° in that direction at a frequency of 95 GHz for a 100 square meter RCS reflector.

Still other objects, features and attendant advantages of the present invention will become apparent to those skilled in the art from a reading of the following detailed description of the preferred embodiment taken in conjunction with the accompanying drawings.

DETAILED DESCRIPTION OF THE INVENTION

Figure 1A:
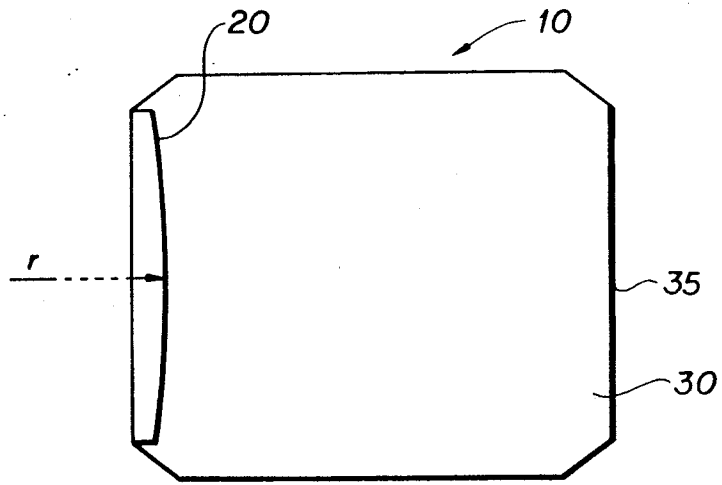
FIG. 1A is a top view of the segmented cylindrical corner reflector.
Figure 1B:
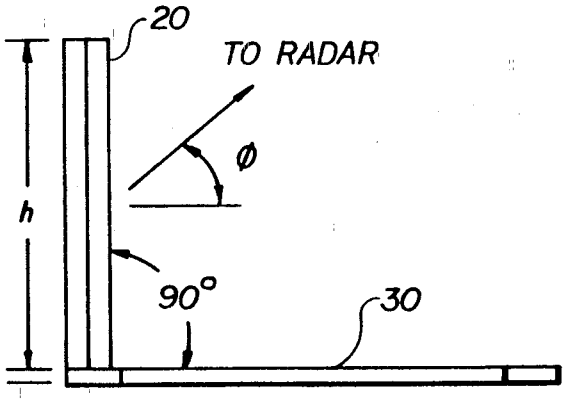
FIG. 1B is a front view of the segmented cylindrical corner reflector.
Figure 1C:
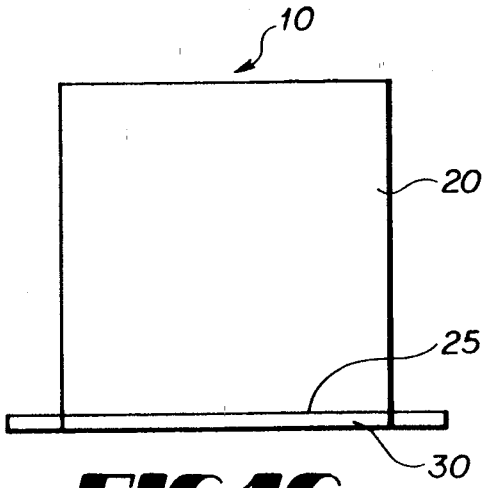
FIG. 1C is a side view of the segmented cylindrical corner reflector.
Figure 2:
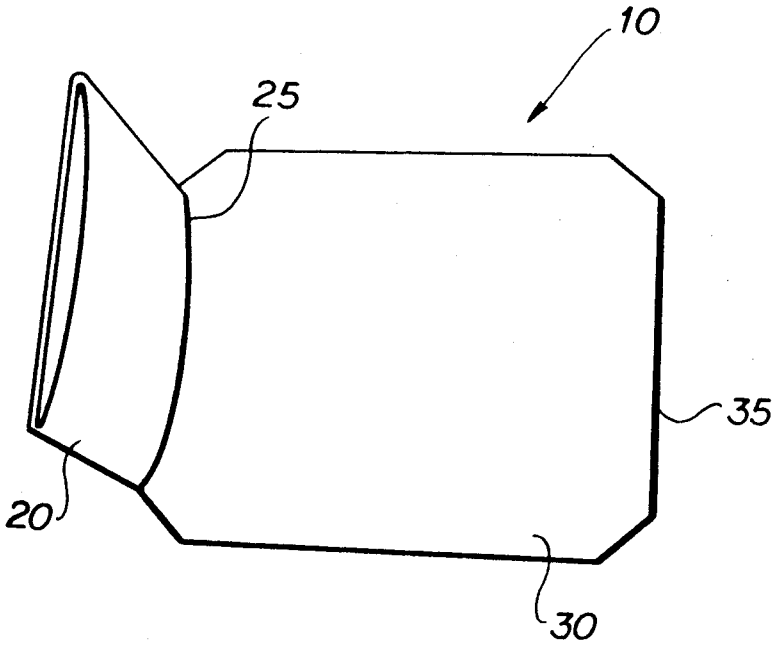
FIG. 2 is a perspective view of the segmented cylindrical corner reflector.

The preferred embodiment of this invention is shown in FIGS. 1 and 2. The segmented cylindrical corner reflector 10 shown in FIGS. 1 and 2 is an even-bounce reflector which comprises a segment of a cylinder 20 fastened to a flat plate 30 so that the surface of the cylindrical surface 20 is oriented at 90° to the flat plate 30.

Figure 4:
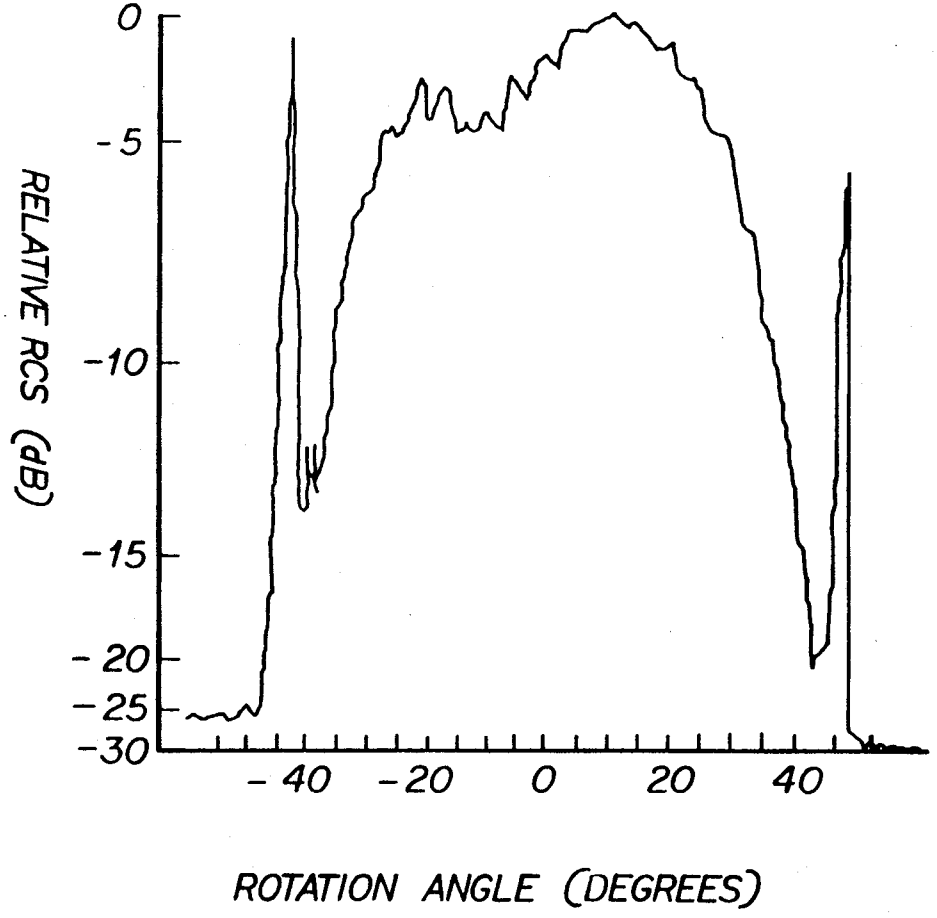
FIG. 4 shows the radar cross section pattern for the segmented cylindrical corner reflector rotated in a plane perpendicular to the seam.
Figure 3:
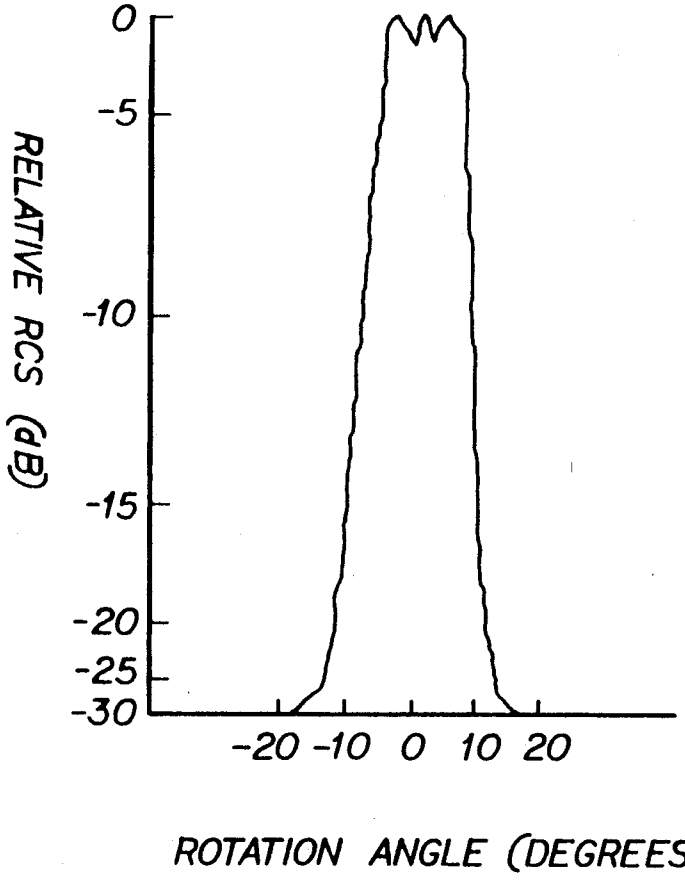
FIG. 3 shows the radar cross section pattern for the segmented cylindrical corner reflector rotated in a plane parallel to the seam.

The properties of this reflector 10 are that it has a relatively broad return pattern as compared to a standard dihedral and a relatively high RCS as compared to a top hat reflector. A dihedral reflector has an extremely narrow return pattern when rotated about a line perpendicular to the seam of the reflector, and is only a few tenths of degree for a typical 100 square meter reflector at 35 GHz. The segmented cylindrical corner reflector 10 has a 110 square meter RCS at 35 GHz and approximately a 10° beam width when rotated about a line perpendicular to the axis, as shown in FIG. 3. The return pattern when the segmented cylindrical corner reflector is rotated about the seam 25 as shown in FIG. 4 is relatively broad. A top hat reflector has a broad pattern in both directions, however, the RCS of a reasonably size reflector is relatively low. The RCS of the segmented cylindrical corner reflector 10 is proportional to the radius of the cylindrical segment so that a radius of 24 inches is quite reasonable for such a reflector, whereas an equivalent top hat reflector would require a 48 inch diameter cylindrical section. Thus an equivalent sized segmented cylindrical corner reflector 10 can have a much larger RCS than a top hat reflector, while still retaining a beamwidth of about 10°.

The RCS of a segmented cylindrical corner reflected can be computed from that of a cylinder. According to R. C. Johnson and H. Jasik, "Antenna Engineering Handbook", Second Edition, 1984, page 17–27, the RCS of a cylinder when illuminated perpendicular to the surface is given by the equation:

$$\sigma = \frac{2\pi r h^2}{\lambda},$$

where $\sigma$ = the scattering cross section of the target, r = the radius of the surface, h = the height of the cylinder, and $\lambda$ = the wavelength.

For the segmented cylindrical corner reflector 10, the equivalent radius r′ is given by the equation:

$$r' = \frac{r}{\cos\phi}$$

where $\phi$ is the angle from the perpendicular to the cylindrical surface.

The equivalent height h′ is given by the equivalent frontal length of the corner reflector, that is $$h' = \frac{h}{\cos\phi}.$$

Thus the equation for computing the RCS of the segmented cylindrical corner reflector 10 is given by:

$$\sigma = \frac{2\pi r h^2}{\lambda \cos^3\phi}.$$

For a radius r equal to 24 inches and a height h equal to 9.49 inches, the computed RCS at $\phi$ equal 45° and at a frequency of 35 GHz is 73.2 square meters. The measured RCS for this size reflector during calibration tests on fabricated reflectors was 69.4 square meters.

The maximum RCS also depends on the length of the flat plate reflector 30. If the flat plate 30 is longer than the cylinder 20, then the maximum cross section will occur at some angle off of $\phi$ equal 45°. For the reflector in this example the distance along the plate plate 30 from the cylindrical surface 20 to the edge 35 is 12.25 inches. Using this dimension, the maximum computed RCS occurs at $\phi$ equals 52.2° and is 113.1 square meters, while the maximum measured RCS during calibration tests was 110 square meters.

I claim:

1. A method for calibrating the orthogonal linear polarizations of a millimeter wave or microwave radar system using a segmented cylindrical corner reflector, comprising the steps:

transmitting a linearly polarized incident wave from said radar towards said segmented cylindrical corner reflector;

orienting said segmented cylindrical corner reflector about an axis parallel to the direction of propagation of said incident wave;

measuring the amplitude and phase of the wave reflected from said segmented cylindrical corner reflector and received back by said radar; and determining the components of the polarization scattering matrix from said reflected wave received by said radar.

2. The method of claim 1 wherein said step of orienting further includes orienting said segmented cylindrical corner reflector with f=45 degrees.

3. A method for calibrating co-polarized circular polarizations of a millimeter wave or microwave radar system using a segmented cylindrical corner reflector, comprising the steps:

transmitting a circularly polarized incident wave from said radar towards said segmented cylindrical corner reflector;

orienting said segmented cylindrical corner reflector about an axis parallel to the direction of propagation;

measuring the amplitude and phase of the wave reflected from said segmented cylindrical corner reflector and received by said radar; and determining the components of the polarization scattering matrix from said reflected wave received by said radar.

4. The method of claim 3 wherein said step of orienting further includes orienting said segmented cylindrical corner reflector with f=45 degrees.

* * * * *